US005426821A

United States Patent [19]

Story

[11] Patent Number: 5,426,821

[45] Date of Patent: Jun. 27, 1995

[54] WRAPAROUND BATHTUB CURTAIN ROD

[76] Inventor: Vincent R. Story, P.O. Box 622, Mayflower, Ark. 72106

[21] Appl. No.: 186,146

[22] Filed: Jan. 25, 1994

[51] Int. Cl.[6] ..... A47K 3/14; A47H 1/06

[52] U.S. Cl. ..... 16/87.4 R; 16/87.2; 4/609; 4/610

[58] Field of Search ..... 16/87.2, 87.4 R, 87.6, 16/87.8, 95 R, 95 D; 4/608-610; 160/124, 126, DIG. 6

[56] References Cited

U.S. PATENT DOCUMENTS

| | | | |
|---|---|---|---|
| 548,192 | 10/1895 | Groth | 16/87.4 R |
| 613,543 | 11/1898 | Willbur | 16/87.4 R |
| 913,344 | 2/1909 | Wukmanic | 16/87.4 R |
| 2,923,013 | 2/1960 | Wasserman | 4/610 |
| 3,637,084 | 1/1972 | Uitz | 16/94 D |
| 3,766,572 | 10/1973 | Wright | 4/610 |
| 3,766,597 | 10/1973 | Ford et al. | 16/87.4 R |
| 4,117,557 | 10/1978 | McPeak et al. | 4/610 |
| 4,769,862 | 9/1988 | Skrzelowski | 4/610 |
| 5,101,522 | 4/1992 | Prian | 4/610 |
| 5,216,766 | 6/1993 | Lang | 4/609 |

*Primary Examiner*—Lowell A. Larson
*Assistant Examiner*—Donald M. Gurley
*Attorney, Agent, or Firm*—Ray F. Cox

[57] ABSTRACT

A shower curtain rod has curved ends branching from the straight body. A curtain hung therefrom is caused to follow a curved contour of a bathtub below. Tracks are provided on the inner and outer sides of the curtain rod so that inner and outer curtains may be suspended therefrom. The inner curtain follows the bathtub contour, and the outer curtain extends to both of two parallel walls defining the shower stall. Curtain fasteners are slidably held within the tracks. The fasteners are insertable when turned ninety degrees from their normal, vertical orientation, then turned so that fastener hooks face downwardly. The fasteners are thus positively retained by the curtain rod, while allowing the curtains to be opened and closed independently from one another.

2 Claims, 2 Drawing Sheets

WRAPAROUND BATHTUB CURTAIN ROD

BACKGROUND OF THE INVENTION

1. Field Of The Invention

The present invention relates to curtain rods for shower stalls, and more particularly to a curtain rod contoured so that a curtain suspended therefrom follows the contour of a conventional bathtub, thus facilitating sealing of the shower stall from the exterior thereof.

2. Description Of The Prior Art

Curtain rods contoured to permit a hanging curtain to follow the contour of a conventional bathtub, in order to facilitate sealing of the shower stall area by the curtain, are known. U.S. Pat. No. 2,778,030, issued to Jean Goche on Jan. 22, 1957, is an example. Goche's device offsets the main length of the curtain rod with respect to the ends abutting supporting walls.

In U.S. Pat. No. 2,923,013, issued on Feb. 2, 1960, Morris Wasserman discloses an attachment for use with ordinary straight rods. The attachment adds a curved section to one end of the rod so that a shower curtain attached thereto will follow a curved corner of the bathtub. In both the Goche and Wasserman patents, shower hooks depend from rings, the rings encircling the curtain rod.

In U.S. Pat. No. 4,769,862, issued on Sept. 13, 1988 to David S. Skrzelowski, a curtain support assembly is provided which includes a track on the shower stall side which slidably holds shower curtain fasteners. The Skrzelowski invention is somewhat complicated, having inner and outer rod extrusions, and numerous other parts.

None of the above inventions and patents, taken either singly or in combination, is seen to describe the instant invention as claimed.

The present invention provides a curtain rod having the ability to cause a shower curtain to conform to the contour of a bathtub wall, while also supporting a second curtain rod on the outside of a shower stall. The problem solved by curtain rods curved to cause the curtain to follow the tub contour is well explained in the prior art. However, the examples cited above have excessive expenses inherent therein. Additional problems not satisfactorily addressed in the prior art are those of aesthetics, ease of installation and avoidance of damage to a shower stall.

As has become increasingly popular, the ability to hang both an inner, water constraining line curtain as well as an outer, aesthetically pleasing curtain is a desirable attribute of a shower curtain rod. Also, it is desirable to employ pressure, or a minimal number of fasteners penetrating a shower stall wall.

Goche's offset curtain rod requires large fastening means to overcome a torque exerted by the weight of the shower curtain and of the offset length of curtain rod. The plate requires a significant number of fasteners penetrating a shower stall wall. This is objectionable since many such walls are of ceramic tile, which is susceptible to damage upon penetration by fasteners. Even where other wall constructions are employed, it is not good practice to require penetrations, since these walls constraining water from a shower to remain within the stall.

Wasserman's device prevents a shower curtain from being opened maximally, the curtain being drawn tight against the curved member of his invention, since the Y formed by divergence of the curved member and the straight rod provides an interference. To hang both inner and outer curtains can be performed with the Wasserman device, but, again, maximal retraction of the curtains is difficult since they will tend to bunch, thus resisting retraction. Furthermore, retraction of only the inner or only the outer curtain cannot easily be accomplished.

The Skrzelowski invention has complicated internal construction, and also lacks means to suspend an outer curtain.

Accordingly, it is a principal object of the invention to provide a shower curtain rod constraining an inner curtain to follow the contour of a bathtub wall as the curtain hangs.

It is another object of the invention to provide a shower curtain rod supporting inner and outer curtains independently, whereby one curtain may be drawn without moving the other.

It is a further object of the invention to provide a shower curtain rod of uncomplicated construction.

Still another object of the invention is to provide a shower curtain rod enabling ready installation and removal of a single shower curtain fastener.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figures 1, 10:
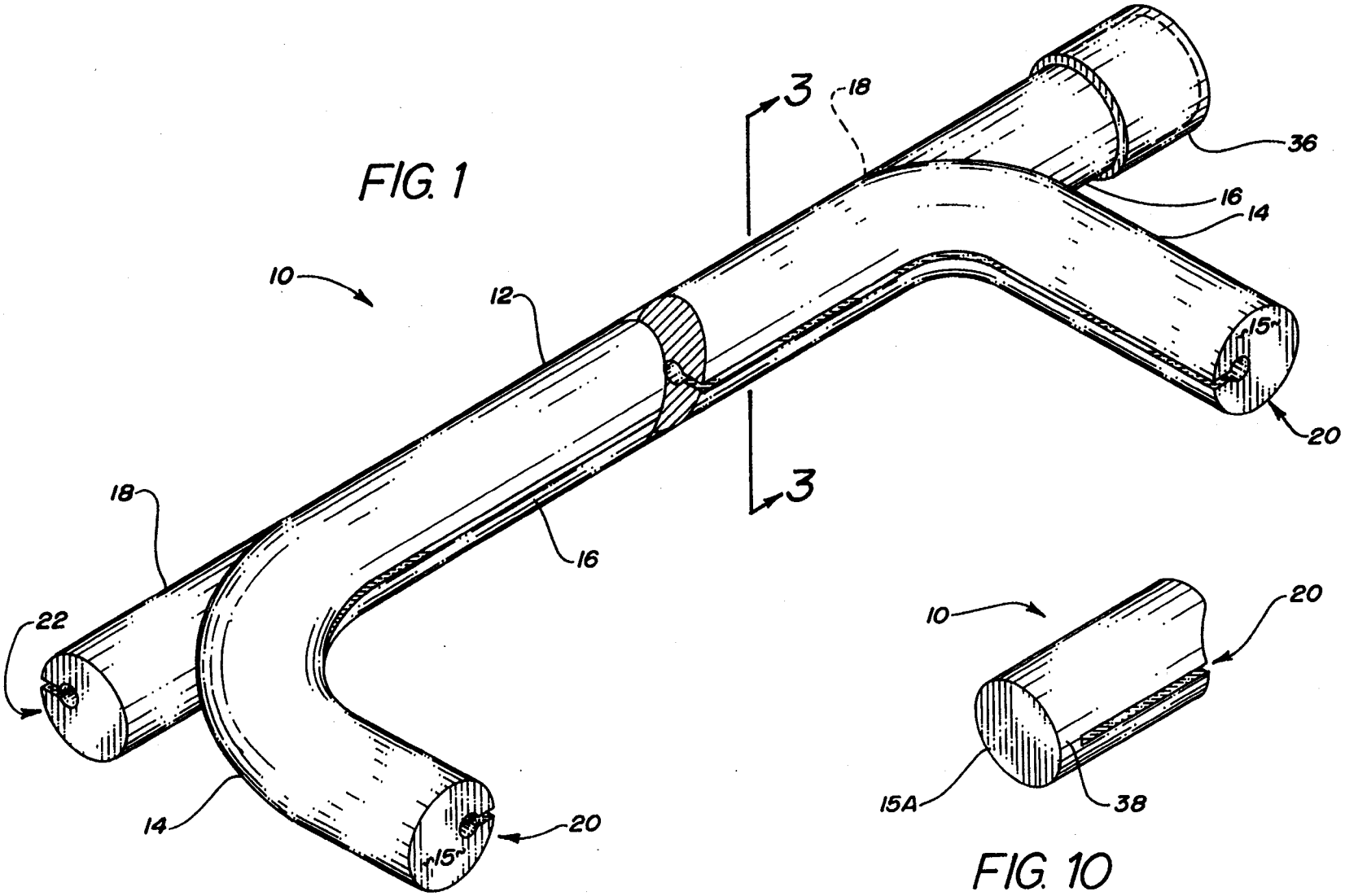
FIG. 1 a perspective view of the invention partly broken away to reveal internal detail.
FIG. 10 is a perspective detail view of a terminal end of an alternative embodiment curtain rod.

The shower curtain rod 10 of the present invention is seen in FIG. 1 to include a section of straight curtain rod 12 having a curved, diverging branch 14 at each end. The arcuate branches 14 curve away from the section of straight rod 12 to conform to bathtub wall curvature below (not shown), so that a curtain (not shown) suspended therefrom will hang straight down, while also conforming to the tub wall curvature. Each branch 14 terminates in a terminal or end 15. Hereinafter, the section of straight rod will be referred to as a longitudinal body 12, and the arcuate branches diverging therefrom will be referred to as contoured ends 14.

The contoured ends 14 face the inside of the shower stall (not shown), this orientation being referred to as the inner side 16 of the curtain rod 10, the longitudinal body 12 facing the exterior of the stall, or outer side 18 of the curtain rod 10. Preferably, a curtain serving as a water barrier is suspended from the curtain rod inner side 16 in a manner to be discussed hereinafter, and follows the tub curvature. A decorative curtain is suspended on the curtain rod outer side 18, and can be drawn to extend from one shower stall wall to the other (walls not shown).

Figure 3:
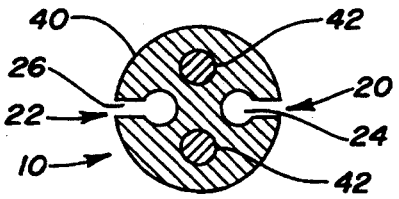
FIG. 3 is a cross sectional view of the novel curtain rod taken along line 3—3 of FIG. 1.

Inner and outer tracks 20, 22 are formed, respectively, in the curtain rod inner and outer sides 16, 18. The tracks 20, 22, seen in FIG. 3, comprise grooves having an interior chamber 24 in the exterior of the curtain rod 10. The interior chamber 24 is of greater diameter than the neck 26.

Tracks 20, 22 may extend the length of the longitudinal body 12 and the contoured ends 14 as shown in FIG. 1. In an alternative embodiment, the tracks 20, 22 may extend a lesser distance, defining a short section of wall 38 providing a stop preventing fasteners 28 from sliding out of engagement with the curtain rod 10. The terminal wall 15A, shown in FIG. 10, conceals the tracks 20, 22, thus further improving the aesthetics of the curtain rod 10. Of course, the longitudinal body 12 may similarly have a terminal wall 15A to provide the same benefits thereto.

Figure 6:
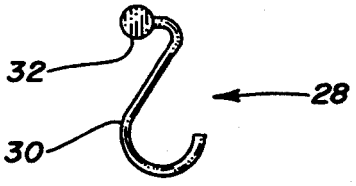
FIG. 6 is a front elevational view of a curtain fastener used with the novel curtain rod.
Figure 9:
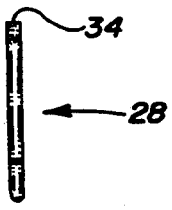
FIG. 9 is a side elevational view of a curtain fastener.

Curtain rod fasteners 28 comprising hook portions 30 and enlarged heads 32, seen in FIG. 6, are slidably held within the tracks 20, 22. The hook 30 engages a corresponding hole in a shower curtain (not shown) in conventional fashion. The fastener head 32 is turned sideways so that the thin dimension 34 of the head 32 (seen in FIG. 9) is inserted into the neck 26 of the track 20 or 22 as shown by fastener 28 in FIG. 2, and rotated a quarter turn, the hook 30 now facing upwardly. The fastener 28 will then be held within the track 20 or 22 in an orientation shown by fasteners 28A in FIG. 2. This arrangement of installing the fastener 28 in the curtain rod 10 will be referred to as being in keyed fashion. The fastener 28 is now slidably supported on the curtain rod 10, and a shower curtain (not shown) can be suspended therefrom.

A cap 36 (see FIG. 1) slidably surrounding the longitudinal body 12 is biased, as by a spring (not shown), to hold the curtain rod 10 in place within a shower stall. Alternatively, the curtain rod 10 is made from resilient material, the resilience providing the biasing force.

Figure 7:
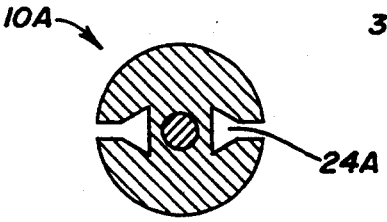
FIG. 7 is similar to FIG. 3, but shows still another alternative embodiment curtain rod.
Figure 8:
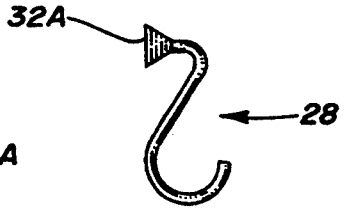
FIG. 8 is a front elevational view of an alternative embodiment curtain fastener employed with the alternative embodiment rod of FIG. 7.

In alternative embodiments, configurations of curtain fastener heads other than round are possible. An example is a substantially triangular head 32A, illustrated in FIG. 8, which would be employed with the curtain rod 10A shown in FIG. 7, this rod 10A having a corresponding triangular track chamber 24A.

Figure 2:
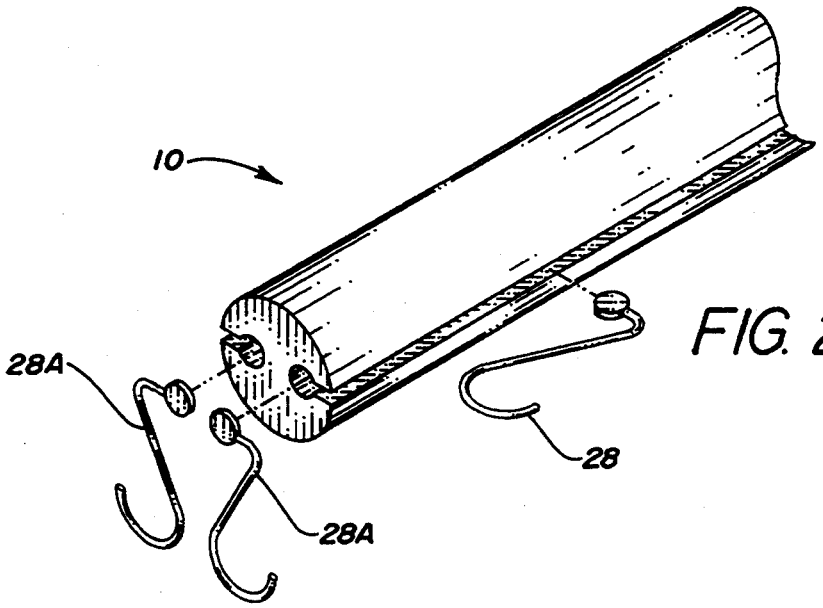
Fig. 2 a perspective detail view of the invention including a cross section, showing curtain fasteners and how they are supported, within the novel curtain rod.

The curtain rod 10 is preferably formed as a single, monolithic piece, as shown in FIG. 2, the entire member being molded or extruded from a synthetic resin or other suitable material, there being no hollow core. In the construction of another alternative embodiment shown in FIG. 3, the curtain rod 10 is also a single, solid piece, but comprises an outer member 40 formed around one or more elongated reinforcing members 42. This latter construction includes two metallic reinforcing rods 42 and a synthetic resin outer member 40.

Of course, the curtain rod could be formed to have a hollow core, should that be deemed desirable.

Figure 4:
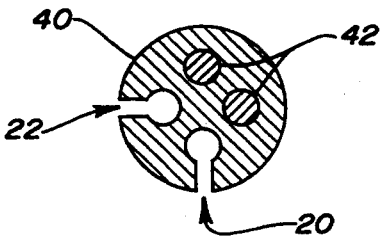
Fig. 4 is similar to FIG. 3 but illustrates an alternative embodiment curtain rod.

Referring now to FIG. 4, it will be seen that in other alternative embodiments, inner and outer tracks 20, 22 may be located at positions other than diametrically opposed. Reinforcing members 42, if employed, would be relocated so as not to interfere with inner and outer tracks 20, 22.

Figure 5:
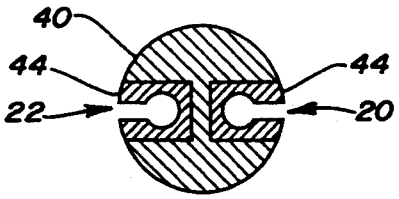
FIG. 5 is similar to FIG. 3, but shows another alternative embodiment curtain rod.

In a further alternative embodiment as shown in FIG. 5, the reinforcing members also define the inner and outer tracks 20, 22. This alternative embodiment reinforcing member 44 enables the tracks 20, 22 to be made from a more durable material, such as metal, the outer curtain rod member 40 being made from a less expensive or more easily shaped material, such as synthetic resin. Preferably, the reinforcing members 44 are not round in cross section, so that rotation within the surrounding member 40 is prevented should a bond between the outer member 40 and a reinforcing member 44 fail.

It is to be understood that the present invention is not limited to the sole embodiment described above, but encompasses any and all embodiments within the scope of the following claims.

What is claimed is:

1. For use in a combined bathtub and shower stall, a contoured curtain rod supported by and between first and second parallel, vertical environmental surfaces of the bathtub and shower stall, comprising:

a straight longitudinal body having proximal and distal ends, said proximal and distal ends being supported on the first and second vertical environmental surfaces, respectively, a first contoured end located proximate said proximal end, said first contoured end forming a first arc-shaped extension of said longitudinal body and having a terminal wall, said first contoured end branching from said longitudinal body and curving away therefrom, so as to be parallel to the first environmental surfaces, said arc shaped extension ending in said terminal wall, and a second contoured end located proximate said distal end, said second contoured end forming a second arc-shaped extension of said longitudinal body and having a second terminal wall, said second contoured end branching from said longitudinal body and curving away therefrom so as to be parallel to the second environmental surface, said second arc-shaped extension ending in said second terminal wall, means defining an inner track comprising a first slot in said contoured curtain rod along said straight longitudinal body and along said first and second contoured ends, said inner track being disposed on a side of said longitudinal body and said first and second contoured ends facing the bathtub and shower stall, said contoured curtain rod including at least one shower curtain fastener slidably held within said inner track, whereby a first shower curtain is retractably supported inside the shower stall, said first shower curtain being constrained as it hangs to follow contours of the bathtub and shower stall, said first slot of said inner track further comprising a narrow neck defined by a traverse width and communicating with an interior chamber, said interior chamber being defined by a chamber transverse cross section having transverse dimensions greater than said transverse width of said narrow neck, and said shower curtain fastener further comprising a hook portion engaging said first shower curtain and a head portion, said head portion being defined by a fastener transverse cross section complementary to said chamber transverse cross section and a longitudinal width characterized by a narrow dimension less than said transverse width of said narrow neck, whereby said head portion of said shower curtain fastener may be removably inserted into said first slot by orienting said narrow dimensions of said head portion to said narrow neck, inserting said head portion through said narrow neck to said interior chamber and rotating said head portion through a right angle to slidably engage said fastener transverse cross section to said chamber transverse cross section.

2. The contoured curtain rod of claim 1, further comprising means defining an outer track comprising a second slot in said contoured curtain rod along said straight longitudinal body, said outer track extending substantially from the first environmental surface to the second environmental surface, said outer track facing away from the bathtub and shower stall, said contoured curtain rod including at least one shower curtain fastener slidably held within said outer track, whereby a second shower curtain is retractably supported outside the bathtub and shower stall, said second slot of said outer track further comprising a narrow neck defined by a traverse width and communicating with an interior chamber, said interior chamber being defined by a chamber transverse cross section having transverse dimensions greater than said transverse width of said narrow neck, and said shower curtain fastener further comprising a hook portion engaging said second shower curtain and a head portion, said head portion being defined by a fastener transverse cross section complementary to said chamber transverse cross section and a longitudinal width characterized by a narrow dimension less than said transverse width of said narrow neck, whereby said head portion of said shower curtain fastener may be removably inserted into said second slot by orienting said narrow dimensions of said head portion to said narrow neck, inserting said head portion through said narrow neck to said interior chamber and rotating said head portion through a right angle to slidably engage said fastener transverse cross section to said chamber transverse cross section.

* * * * *